US011202945B2

(12) United States Patent
Suk et al.

(10) Patent No.: US 11,202,945 B2
(45) **Date of Patent: *Dec. 21, 2021**

(54) GOLF CLUB HEAD WITH AIRFOIL

(71) Applicant: ESS 2 Tech, LLC, Bethlehem, PA (US)

(72) Inventors: Michael Suk, Milton, PA (US); David A. Shoffler, Marion Heights, PA (US)

(73) Assignee: ESS 2 Tech, LLC, Bethlehem, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/937,668

(22) Filed: Jul. 24, 2020

(65) Prior Publication Data

US 2020/0353319 A1 Nov. 12, 2020

Related U.S. Application Data

(63) Continuation of application No. 16/385,234, filed on Apr. 16, 2019, now Pat. No. 10,751,583.

(51) Int. Cl.
*A63B 53/04* (2015.01)

(52) U.S. Cl.
CPC ..... *A63B 53/04* (2013.01); *A63B 53/0408* (2020.08); *A63B 53/0433* (2020.08); *A63B 53/0437* (2020.08); *A63B 53/0466* (2013.01); *A63B 2225/01* (2013.01)

(58) Field of Classification Search
CPC ..... A63F 2225/01; A63B 2053/0433; A63B 53/0466; A63B 53/04; A63B 2225/01
USPC ..... 473/327, 344
See application file for complete search history.

(56) References Cited

U.S. PATENT DOCUMENTS

| | | | | |
|---|---|---|---|---|
| 3,929,369 A | | 12/1975 | Blair | |
| 4,318,565 A | | 3/1982 | Lay | |
| 4,431,192 A | * | 2/1984 | Stuff, Jr. | A63B 53/04 473/327 |
| 4,434,957 A | | 3/1984 | Moritz | |
| 4,603,898 A | | 8/1986 | Udagawa et al. | |
| 4,611,796 A | | 9/1986 | Orr | |
| 4,674,788 A | | 6/1987 | Ohmura et al. | |
| 4,838,555 A | * | 6/1989 | Kobayashi | A63B 53/04 473/327 |
| 5,106,147 A | | 4/1992 | Okada et al. | |
| 5,324,092 A | | 6/1994 | Burg | |

(Continued)

FOREIGN PATENT DOCUMENTS

| | | |
|---|---|---|
| DE | 322283 | 6/1920 |
| WO | 2020214460 A1 | 10/2020 |

OTHER PUBLICATIONS

Computer translation of DE 322283 (Year: 1920).

(Continued)

*Primary Examiner* — Benjamin Layno
(74) *Attorney, Agent, or Firm* — Plumsea Law Group, LLC

(57) ABSTRACT

A golf club head for a driver is disclosed. The golf club head includes a face portion and a rearward end portion. An upward facing surface in a crown portion of the golf club head curves up towards the rearward end portion to keep airflow from separating from the crown portion. A downward facing surface on a sole portion of the golf club includes an airfoil that helps keep air stuck to the sole portion of the golf club head. The airfoil portion extends across a substantial entirety of the width of the golf club head.

20 Claims, 5 Drawing Sheets

(56) References Cited

U.S. PATENT DOCUMENTS

| | | | | |
|---|---|---|---|---|
| 5,356,195 | A | 10/1994 | Kanda | |
| 5,382,070 | A | 1/1995 | Turner | |
| 5,456,469 | A | 10/1995 | MacDougall | |
| 5,511,786 | A | 4/1996 | Antonious | |
| 5,524,890 | A | 6/1996 | Kim et al. | |
| 5,643,107 | A | 7/1997 | Gorman | |
| 5,735,754 | A | 4/1998 | Antonious | |
| 5,980,394 | A * | 11/1999 | Domas | A63B 53/0466 473/327 |
| 6,168,537 | B1 | 1/2001 | Ezawa | |
| 6,183,041 | B1 | 2/2001 | Wilson | |
| 6,319,148 | B1 | 11/2001 | Leung | |
| 6,663,503 | B1 | 12/2003 | Kenmi | |
| D498,508 | S | 11/2004 | Antonious | |
| D589,100 | S | 3/2009 | Rice et al. | |
| D594,074 | S | 6/2009 | Foster et al. | |
| D608,850 | S | 1/2010 | Oldknow | |
| D609,297 | S | 2/2010 | Oldknow | |
| D609,764 | S | 2/2010 | Oldknow | |
| 8,091,951 | B1 | 1/2012 | Fitzgerald | |
| 8,162,775 | B2 | 4/2012 | Tavares et al. | |
| 8,226,501 | B2 | 7/2012 | Stites et al. | |
| D669,948 | S | 10/2012 | Sakamoto | |
| D669,949 | S | 10/2012 | Sakamoto | |
| 8,328,658 | B2 | 12/2012 | Bennett et al. | |
| 8,366,565 | B2 | 2/2013 | Tavares et al. | |
| 8,517,862 | B2 | 8/2013 | Stites et al. | |
| 8,690,704 | B2 | 4/2014 | Thomas | |
| 8,702,531 | B2 | 4/2014 | Boyd et al. | |
| 8,758,156 | B2 | 6/2014 | Stites et al. | |
| 8,821,309 | B2 | 9/2014 | Boyd et al. | |
| 8,870,679 | B2 | 10/2014 | Oldknow | |
| 8,932,149 | B2 | 1/2015 | Oldknow | |
| 8,986,134 | B2 | 3/2015 | Stites et al. | |
| 9,403,069 | B2 | 8/2016 | Boyd et al. | |
| 9,662,551 | B2 | 5/2017 | Akiyama et al. | |
| 9,695,799 | B2 | 7/2017 | Aihara et al. | |
| D802,069 | S | 11/2017 | Parsons et al. | |
| 9,999,812 | B2 | 6/2018 | Oldknow et al. | |
| 10,751,583 | B1 * | 8/2020 | Suk | A63B 53/04 |
| 2002/0077195 | A1 * | 6/2002 | Carr | A63B 60/00 473/328 |
| 2004/0018891 | A1 | 1/2004 | Antonious | |
| 2004/0152537 | A1 | 8/2004 | Moore | |
| 2005/0009622 | A1 | 1/2005 | Antonious | |
| 2005/0049073 | A1 | 3/2005 | Herber | |
| 2005/0064953 | A1 | 3/2005 | Moore | |
| 2006/0169847 | A1 | 8/2006 | Konings | |
| 2006/0232102 | A1 | 10/2006 | Steel | |
| 2007/0099726 | A1 | 5/2007 | Rife | |
| 2007/0149310 | A1 | 6/2007 | Bennett et al. | |
| 2009/0124410 | A1 * | 5/2009 | Rife | A63B 53/0466 473/328 |
| 2011/0181072 | A1 | 7/2011 | Kempster | |
| 2015/0008699 | A1 | 1/2015 | Yamaguchi et al. | |
| 2017/0334491 | A1 | 11/2017 | Dieckmann et al. | |
| 2018/0312203 | A1 | 11/2018 | Smith | |
| 2019/0093629 | A1 | 3/2019 | Juarez | |
| 2019/0202503 | A1 | 7/2019 | Suk et al. | |

OTHER PUBLICATIONS

Office Action dated Jan. 16, 2020 for U.S. Appl. No. 15/969,347.
International Search Report and Written Opinion dated May 22, 2020 for Application No. PCT/US2020/027129.
International Preliminary Report on Patentability dated Oct. 28, 2021 for Application No. PCT/US2020/027129.

* cited by examiner

GOLF CLUB HEAD WITH AIRFOIL

CROSS-REFERENCE TO RELATED APPLICATIONS

This application is a continuation of U.S. patent application Ser. No. 16/385,234 filed Apr. 16, 2019, and titled "Golf Club Head with Airfoil," now U.S. Pat. No. 10,751,583 which is incorporated by reference herein in its entirety.

BACKGROUND OF THE INVENTION

The present invention relates generally to golf clubs, and in particular to golf clubs with aerodynamic features.

The distance that a golf ball travels when hit by the face of a golf club is determined by the velocity of the club head at the moment of impact with the ball. Drag from the air may reduce the speed of the club head. Some golf clubs use grooves deployed along the top of the club head to decrease resistance and drag. However, the downward curvature of the top surfaces of traditional golf club heads may lead to separation of the airflow along the top, decreasing the efficiency of the upper grooves.

There is a need in the art for a golf club that addresses the shortcomings discussed above.

SUMMARY OF THE INVENTION

In one aspect, a golf club head for a driver includes a face portion providing a ball contacting surface, a rearward end portion, and a crown portion including an upward facing surface, where the upward facing surface extends from the ball contacting surface to the rearward end portion. The golf club head also includes a sole portion disposed opposite of the crown portion, where the sole portion includes a downward facing surface, and where the downward facing surface extends from the ball contacting surface to the rearward end portion. The sole portion includes an airfoil portion disposed adjacent the face portion. The ball contacting surface defines a reference axis approximately parallel with the ball contacting surface and oriented in a direction between the crown portion and the sole portion. A lower edge of the face portion has a first position along the reference axis, an upper edge of the face portion has a second position along the reference axis, and the rearward end portion has a third position along the reference axis. The third position is disposed further from the first position than is the second position from the first position.

In another aspect, a golf club head for a driver includes a shaft receiving portion, a face portion providing a ball contacting surface, a rearward end portion, and a crown portion including an upward facing surface, where the upward facing surface extends from the ball contacting surface to the rearward end portion. The golf club head also includes a sole portion disposed opposite of the crown portion, where the sole portion includes a downward facing surface, and where the downward facing surface extends from the ball contacting surface to the rearward end portion. The face portion has a toe portion and a heel portion, where the toe portion is disposed further from the shaft receiving portion than is the heel portion from the shaft receiving portion. The sole portion includes an airfoil portion disposed adjacent the face portion, and the airfoil portion extends at least seventy percent of the distance between the toe portion and the heel portion.

In another aspect, a golf club head for a driver includes a face portion providing a ball contacting surface, a rearward end portion, and a crown portion including an upward facing surface, where the upward facing surface extends from the ball contacting surface to the rearward end portion. The golf club head also includes a sole portion disposed opposite of the crown portion, where the sole portion includes a downward facing surface, and where the downward facing surface extends from the ball contacting surface to the rearward end portion. The sole portion includes an airfoil portion. The airfoil portion includes a raised suction surface disposed adjacent the face portion, a recessed suction surface disposed rearwardly of the raised suction surface, and an elliptic surface connecting the raised suction surface and the recessed suction surface.

Other systems, methods, features, and advantages of the invention will be, or will become, apparent to one of ordinary skill in the art upon examination of the following figures and detailed description. It is intended that all such additional systems, methods, features, and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
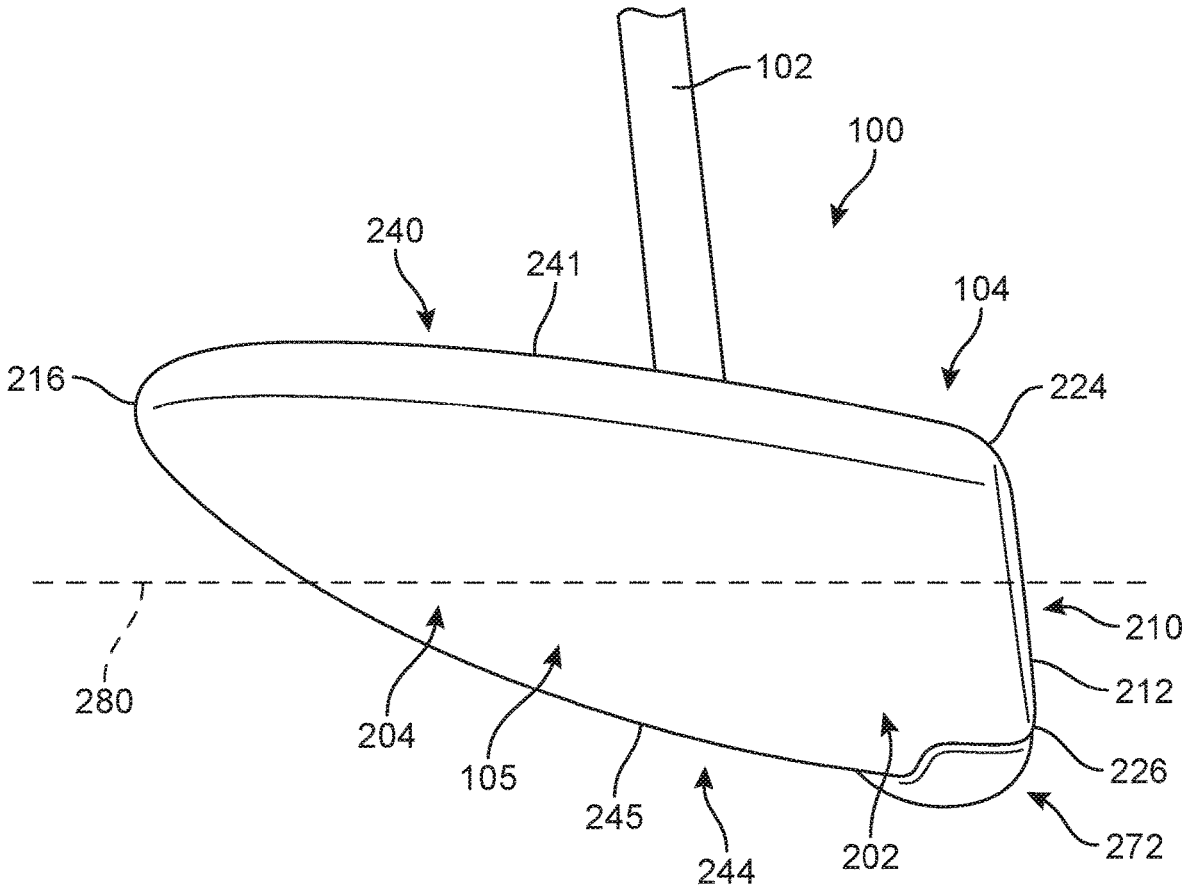
FIG. 1 is a schematic side view of a portion of a golf club, according to an embodiment.

FIG. 1 is a schematic view of a golf club 100 with a shaft member 102 and a club head 104. In the exemplary embodiment, golf club 100 is a driver. However, in other embodiments, the principles described herein could be incorporated into other golf clubs that may have a suitable geometry.

Figure 5:
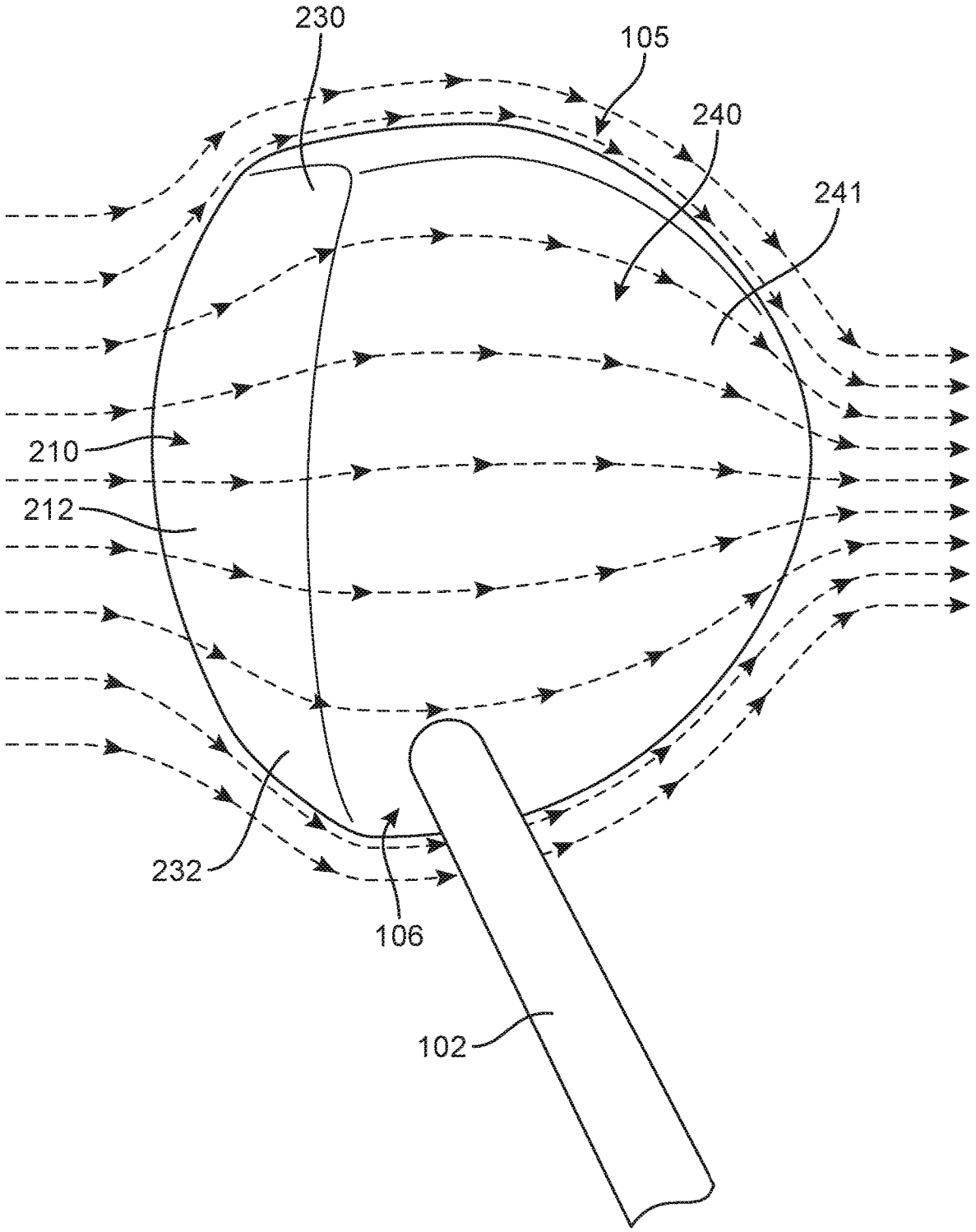
FIG. 5 is a schematic top down view of a golf club showing airflow over the crown portion of the golf club head and along the toe portion and heel portion of the golf club head, according to an embodiment.

Club head 104 may include a club head body portion 105 and shaft receiving portion 106 (also referred to as a hosel), as best seen in FIG. 5. Club head 104 may include a forward portion 202 and a rearward portion 204. Forward portion 202 further includes a face portion 210. Face portion 210 further includes a ball contacting surface 212 (see FIG. 5). Rearward portion 204 may further include a rearward end portion 216. For clarity, reference is made to a longitudinal, or lengthwise, axis 280 that extends between face portion 210 and rearward end portion 216, and through both forward portion 202 and rearward portion 204. Along longitudinal axis 280, a forward direction is oriented from rearward portion 204 towards face portion 210, while a rearward direction is oriented from forward portion 202 towards rearward end portion 216.

As best seen in FIG. 5, club head 104 may also include a toe portion 230 and a heel portion 232. Heel portion 232 may be disposed adjacent to shaft receiving portion 106, while toe portion 230 may be disposed furthest from shaft receiving portion 106. The extension of club head 104 between toe portion 230 and heel portion 232 may be characterized as a widthwise, or lateral, direction or dimension of club head 104. This widthwise dimension may generally extend in an approximately perpendicular direction to longitudinal axis 280.

Club head 104 may also include a crown portion 240 that includes an upward facing surface 241. Club head 104 may also include a sole portion 244 that includes a downward facing surface 245. Upward facing surface 241 may extend from an upper edge 224 of face portion 210 up to rearward end portion 216 in an approximately longitudinal direction. Downward facing surface 245 may extend from a lower edge 226 of face portion 210 up to rearward end portion 216 in an approximately longitudinal direction.

Club head 104 may incorporate an airfoil portion 272. As used herein, the term airfoil (or aerofoil) is any structure with curved surfaces that produces an aerodynamic force when moved through a fluid. As used herein, the term "fluid" may refer to any Newtonian Fluid. In other embodiments, airfoils could be used with Non-Newtonian Fluids.

Airfoil portion 272 may be disposed along downward facing surface 245. Furthermore, a leading end of airfoil portion 272 may associated with lower edge 226 of face portion 210. A trailing end of airfoil portion 272 may extend rearwardly (in the longitudinal direction) from the leading end. Thus, airfoil portion 272 may be disposed beneath face portion 210 and may help control the airflow along downward facing surface 245 during a swing, as discussed in further detail below.

Figure 2:
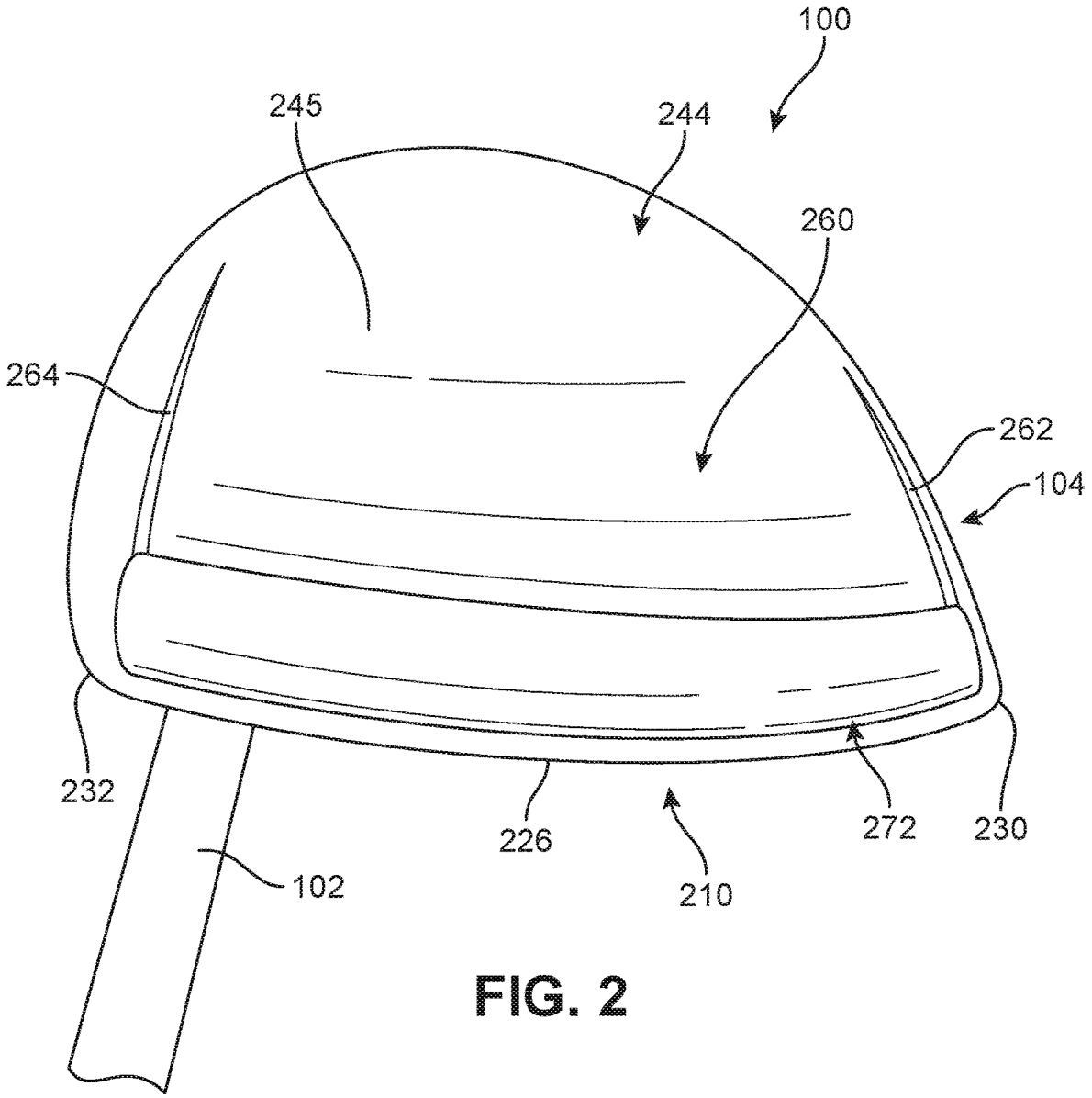
FIG. 2 is a schematic rear view of an embodiment of a golf club.

FIG. 2 is a schematic view of sole portion 244 of club head 104, which is intended to illustrate the configuration of airfoil portion 272 along downward facing surface 245. For clarity, club head 104 is shown in an inverted position, such that shaft 102 is oriented downwards and sole portion 244 is oriented upwards. Referring to FIG. 2, it may be seen that airfoil portion 272 extends across a substantial entirety of the width of sole portion 244 in the exemplary embodiment. That is, airfoil portion 272 extends from toe portion 230 to heel portion 232 of club head 104. By using an airfoil portion that extends over nearly the entire width of sole portion 244, the exemplary configuration helps to maintain smooth laminar airflow beneath the entirety of sole portion 244 during a swing.

Although the exemplary embodiment depicts an airfoil portion that extends through substantially the entire width of a club head, in other embodiments an airfoil portion could have a different width that still helps to maintain laminar airflow along the majority of sole portion 244. In some embodiments, an airfoil portion could extend through a width approximately in the range between 60%-100% of the width of the club head. In other embodiments, an airfoil portion could extend at least 70% of the width of the club head. In the exemplary embodiment, airfoil portion 272 extends at least 90% of the width of the club head.

As seen in FIG. 2, airfoil portion 272 may be formed by creating a depression or recessed portion 260 in sole portion 244. In some cases, this recessed portion 260 extends not only along a portion of club head 104 disposed proximate to face portion 210, but also adjacent to toe portion 230 and heel portion 232. Along lower edge 226 of face portion 210, recessed portion 260 forms airfoil portion 272. Along the toe and heel portions, this recessed portion 260 forms a toe side airfoil portion 262 and a heel side airfoil portion 264. These secondary airfoil portions extend rearwardly from the primary airfoil portion 272 and gradually decrease in depth until downward facing surface 245 is completely smooth at rearward end portion 216. During a golf swing, these secondary airfoil portions may help to control air flowing around the toe and heel sides of the club head.

Figure 3:
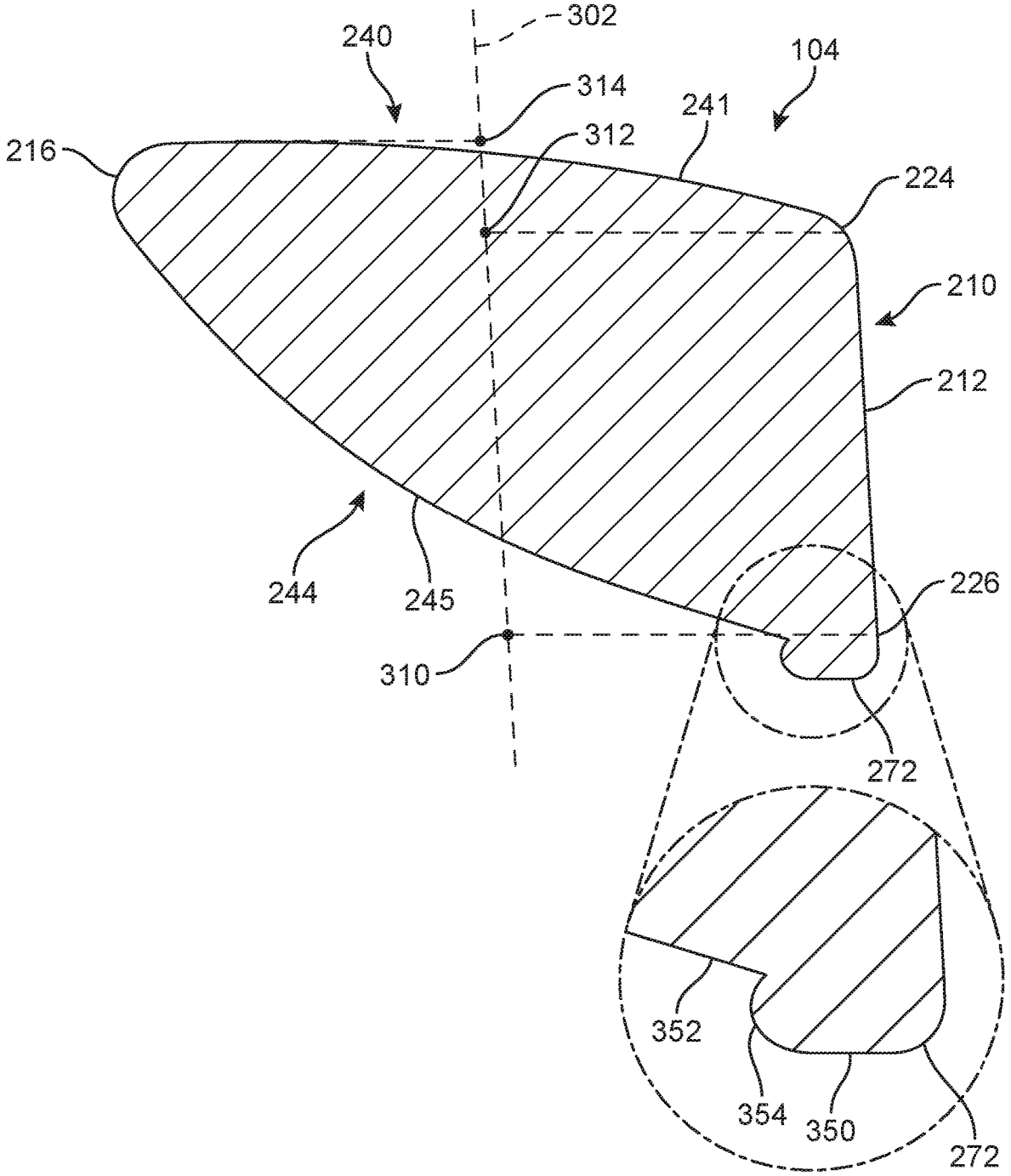
FIG. 3 is a schematic cross-sectional view of an embodiment of a golf club head.

FIG. 3 depicts a schematic profile of the geometry of club head 104 as viewed along the widthwise (or lateral) direction. The geometry of upward facing surface 241 may be chosen to reduce and/or eliminate air separation from crown portion 240 during a swing. In the exemplary embodiment, therefore, upward facing surface 241 slopes gently upwards towards rearward end portion 216. For reference, the relative positions of rearward end portion 216 and upper edge 224 of face portion 210 are compared relative to a reference axis 302. Reference axis 302 is an axis that is parallel with ball contacting surface 212. Reference axis 302 is also oriented so that it extends between crown portion 240 and sole portion 244.

With respect to reference axis 302, lower edge 226 of face portion 210 has a first position 310, upper edge 224 has a second position 312 and rearward end portion 216 has a third position 314. Moreover, as seen in FIG. 3, third position 314 is disposed further from first position 310 than second position 312 is from first position 310. That is, with respect to reference axis 302, rearward end portion 216 is "higher" than upper edge 224 of face portion 210. In still other embodiments, upward facing surface 241 could be approximately flat, so that rearward end portion 216 and upper edge 224 have substantially similar positions with respect to reference axis 302. As discussed in further detail below, by shaping the upward facing surface so that the rearward end portion is higher than the face portion, and/or at a similar height with respect to a suitable reference axis, airflow passing over the crown side of the club head may not separate from the club head. By contrast, in configurations where the rearward end portion of a club head is lower than the upper edge of the face portion, airflow may have a tendency to separate from the crown side of the club during a swing.

As seen in FIG. 3, downward facing surface 245 slopes up from airfoil portion 272 to rearward end portion 216. Moreover, the curvature of downward facing surface 245 may be substantially greater than the curvature of upward facing surface 241, on average. Because of the presence of airfoil portion 272 on downward facing surface 245, air flowing beneath the club head will stay stuck to the sole side, even as the downward facing surface 245 curves more dramatically up towards rear end portion 216. This ensures that the airflow on both the crown and sole sides of the club head remain approximately laminar to reduce drag and help a golfer achieve maximum velocity on their swing.

An airfoil may include provisions for keeping airflow "stuck" on the suction surface and allowing air to be redirected through a large angle. In some embodiments, an airfoil can include a leading airfoil portion that is shaped to control the flow of air along a suction surface.

Referring back to FIG. 3, the profile shape of airfoil portion 272 can clearly be seen in the enlarged view. Airfoil portion 272 includes a raised suction surface 350 disposed adjacent face portion 210 and a recessed suction surface 352 disposed rearwardly of raised suction surface 350. Here, raised suction surface 350 may be associated with a leading end of airfoil portion 272, while recessed suction surface 352 may be associated with a trailing end of airfoil portion 272.

In some embodiments, an airfoil portion could include an elliptic surface. An elliptic surface may be used to connect the raised and lowered suctions surfaces of an airfoil. In the embodiment of FIG. 3, airfoil portion 272 may include an elliptic surface 354 that connects raised suction surface 350 and recessed suction surface 352. Elliptic surface 354 may have a different radius of curvature than raised suction surface 350. Elliptic surface 354 may also have a different radius of curvature than recessed suction surface 352. As used herein, the term "radius of curvature" refers to the reciprocal of the curvature at a particular location on a curve or two-dimensional surface. For a curve, the radius of curvature equals the radius of the circular arc that best approximates the curve at that point. In particular, it should be noted that the larger the radius of curvature of curve, the smaller the curvature (and vice versa). In the exemplary embodiment, elliptic surface 354 has a substantially smaller radius of curvature than either raised suction surface 350 or recessed suction surface 352. Thus, elliptic surface 354 is substantially more curved than raised suction surface 350 and recessed suction surface 352. As discussed in further detail below, this distinct geometry for airfoil portion 272 helps to turn air flowing around lower edge 226 of face portion 210 through a large angle so that the boundary layer stays stuck to downward facing surface 245, even as downward facing surface 245 curves steeply up towards rearward end portion 216.

The embodiments could make use of any of the airfoil properties, including airfoil shapes, which are disclosed in Suk et al., U.S. Patent Application Publication Number 2019/0202503, published on Jul. 4, 2019, and titled "Airfoils and Machines Incorporating Airfoils," the entirety of which is herein incorporated by reference.

Figure 4:
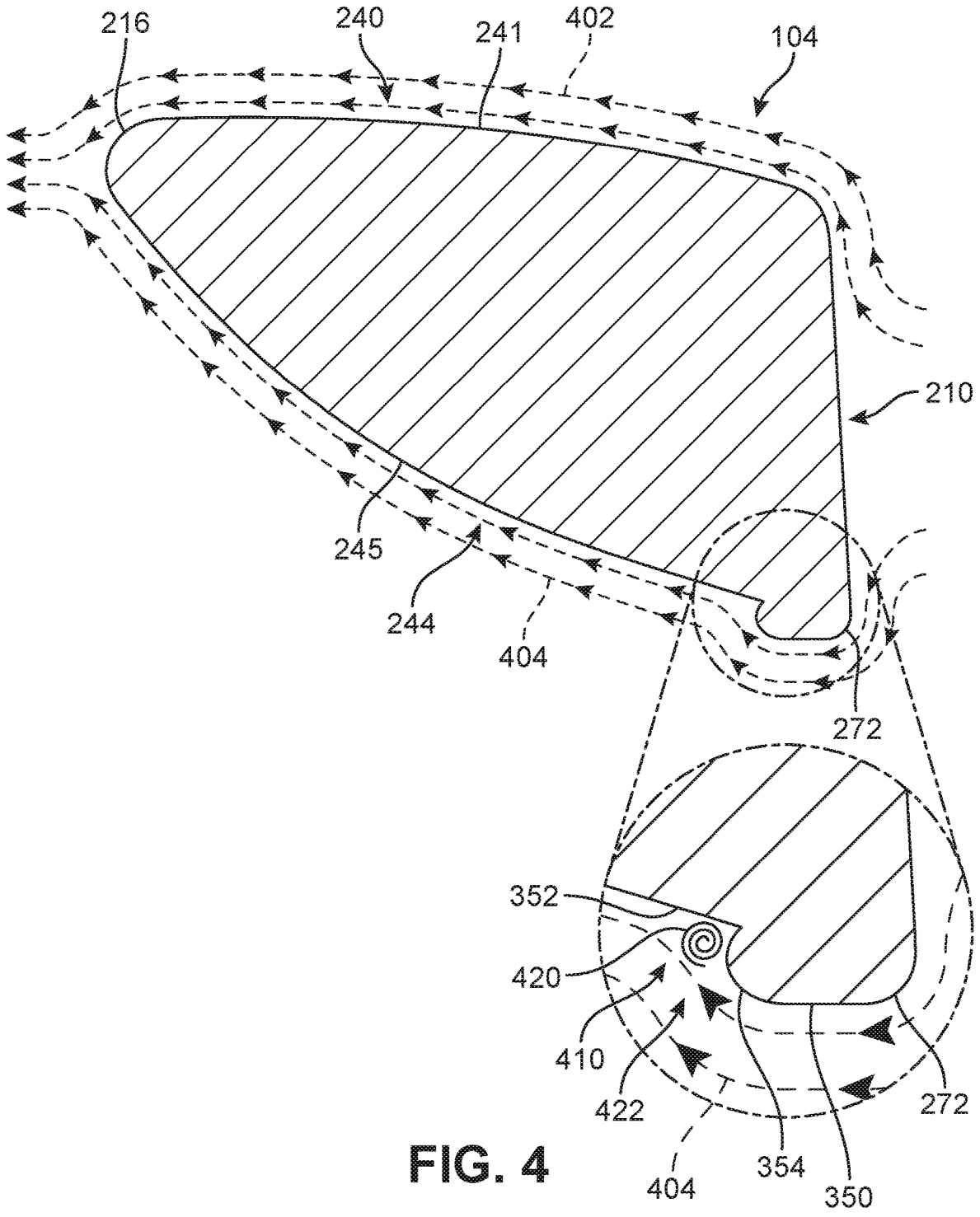
FIG. 4 is a schematic cross-sectional view of the golf head club of FIG. 3 including arrows depicting airflow across the crown portion and sole portion of the golf club head, according to an embodiment.

FIGS. 4-5 depict schematic views of the airflow around club head 104 as it swings towards a ball. As seen in FIG. 4, airflow encountering face portion 210 is moved upwards over crown portion 240, or downwards under sole portion 244. Specifically, a first airflow path 402 passes along upward facing surface 241 and continues to follow the rise in upward facing surface 241 until encountering rearward end portion 216. Thus, it may be seen that the constant rise of upward facing surface 241 helps to keep the first airflow path 402 from separating from upward facing surface 241. This is in contrast to club heads that have upward facing surfaces that eventually slope down towards a rearward end portion, which may cause the airflow passing above to club to separate from the crown side.

The more severe slope of downward facing surface 245 requires the use of airfoil portion 272 to maintain laminar flow along the bottom of the club head. Specifically, a second airflow path 404 initially passes across raised suction surface 350 of airfoil portion 272. Next, the second airflow path 404 is directed across elliptic surface 354 to recessed suction surface 352. As the air flows along the trailing end of airfoil portion 272 it will be turned up (that is, towards rearward end portion 216) to keep it from separating from downward facing surface 245.

As seen in the enlarged view within FIG. 4, the geometry of airfoil portion 272 creates step-down region 410, resulting in an abrupt change in thickness between raised suction surface 350 and recessed suction surface 352. This sudden change in thickness (and geometry) creates vortex 420 (and/or turbulent eddies) at step-down region 410. As air flows over airfoil portion 272, vortex 420 "pulls" the air down and thereby reattaches the boundary layer of the flow as it moves from one surface to the next, keeping the air "stuck" on downward facing surface 245. Airflow moving along downward facing surface 245 flows to rearward end portion 216, where it merges with airflow from upward facing surface 241.

The embodiments utilize specifically curved arc portions adjacent step-down region 410 to help actively control the turbulent eddies or vortices that develop at step-down region 410. Specifically, the combined shapes of raised suction surface 350, elliptic surface 354 and recessed suction surface 352 combine to actively redirect the fluid flow with use of the Coanda effect toward reattachment to the airfoil upper surface. The Coanda effect refers to the tendency of a jet of fluid emerging from an orifice to follow an adjacent flat or curved surface and to entrain fluid from the surroundings so that a region of lower pressure develops. Vortex 420 (and/or turbulent eddies) at step-down region 410 creates a pressure difference between raised suction surface 350 and recessed suction surface 352. The active fluid flowing across these surfaces creates air curtain 422 (via the Coanda effect) that helps hold vortex 420 in place and keeps it attached to downward facing surface 245. Air curtain 422 thus provides a stabilizing force to keep vortex 420 in place, which further serves to prevent the boundary layer from delaminating from airfoil portion 272.

Referring to FIG. 5, air flowing along the toe side and heel side of club head 104 may also be induced to stick to downward facing surface 245 by the presence of the secondary airfoil portions (toe side airfoil portion 262 and heel side airfoil portion 264 shown in FIG. 2). Moreover, the airfoil portion, combined with the shape of the upward and downward facing surfaces described, produces a flow field where the boundary layers are re-attached above and behind the upper surface of the club head.

While various embodiments of the invention have been described, the description is intended to be exemplary, rather than limiting, and it will be apparent to those of ordinary skill in the art that many more embodiments and implementations are possible that are within the scope of the invention. Any element of any embodiment may be substituted for another element of any other embodiment or added to another embodiment except where specifically excluded. Accordingly, the invention is not to be restricted except in light of the attached claims and their equivalents. Also, various modifications and changes may be made within the scope of the attached claims.

The invention claimed is:

1. A golf club head, the golf club head comprising:

a shaft receiving portion;

a face portion providing a ball contacting surface;

a rearward end portion;

a crown portion including an upward facing surface, wherein the upward facing surface extends from the ball contacting surface to the rearward end portion;

a sole portion disposed opposite of the crown portion, the sole portion including a downward facing surface, and the downward facing surface extending from the ball contacting surface to the rearward end portion;

the face portion having a toe portion and a heel portion, wherein the toe portion is disposed further from the shaft receiving portion than is the heel portion from the shaft receiving portion;

the sole portion including an airfoil portion disposed adjacent the face portion;

wherein the airfoil portion includes a raised suction surface disposed proximate a leading end of the airfoil portion and a recessed suction surface forming the downwardly facing surface of the sole portion, the raised suction surface extending downwardly from the recessed suction surface;

wherein the raised suction surface has a substantially constant width between the toe portion and the heel portion; and wherein a forward portion of the airfoil portion extends across a substantial majority of the width of the face portion.

2. The golf club head according to claim 1, wherein the upward facing surface curves up towards the rearward end portion, and wherein the downward facing surface curves up towards the rearward end portion.

3. The golf club head according to claim 2, wherein the downward facing surface curves more towards the rearward end portion than the upward facing surface.

4. The golf club head according to claim 1, wherein the airfoil portion further includes a leading end, a trailing end, and a step-down region disposed between the leading end and the training end;

wherein the leading end of the airfoil portion is disposed at the lower edge of the face portion; and wherein the step-down region is configured to generate a vortex along the sole portion of the golf club head between the face portion and the rearward end portion.

5. The golf club head according to claim 1, wherein the ball contacting surface defines a reference axis approximately parallel with the ball contacting surface and oriented in a direction between the crown portion and the sole portion;

wherein a lower edge of the face portion has a first position along the reference axis, wherein an upper edge of the face portion has a second position along the reference axis, and wherein the rearward end portion has a third position along the reference axis; and wherein the third position is disposed further from the first position than is the second position from the first position.

6. The golf club head according to claim 1, the airfoil portion further comprising:

an elliptic surface connecting the raised suction surface and the recessed suction surface.

7. The golf club head according to claim 6, wherein: the raised suction surface is associated with a leading end of the airfoil portion, and wherein the recessed suction surface is associated with a trailing end of the airfoil portion; wherein the elliptic surface has a smaller radius of curvature than the raised suction surface, and wherein the elliptic surface has a smaller radius of curvature than the recessed suction surface;

and wherein air flowing with sufficient velocity across the raised suction surface and the recessed suction surface generates a vortex adjacent to the elliptic surface.

8. The golf club head according to claim 1, wherein the sole portion includes a recessed portion, and wherein the airfoil portion is associated with a recessed portion of the sole portion.

9. A golf club head, the golf club head comprising:

a shaft receiving portion;

a face portion providing a ball contacting surface;

a rearward end portion;

a crown portion including an upward facing surface, wherein the upward facing surface extends from the ball contacting surface to the rearward end portion;

a sole portion disposed opposite of the crown portion, the sole portion including a downward facing surface, and the downward facing surface extending from the ball contacting surface to the rearward end portion;

wherein the upward facing surface curves up towards the rearward end portion, and wherein the downward facing surface curves up towards the rearward end portion;

the sole portion including an airfoil portion extending downwardly from the face portion such that the airfoil portion is continuous with the ball contacting surface along the face portion; and wherein the airfoil portion is associated with a recessed portion within the sole portion.

10. The golf club head according to claim 9, wherein the recessed portion of the sole portion is associated with a suction surface of the airfoil.

11. The golf club head according to claim 9, wherein a leading end of the airfoil portion is associated with a lower edge of the face portion.

12. The golf club head according to claim 11, wherein a trailing end of the airfoil portion extends rearwardly of the face portion.

13. The golf club head according to claim 9, wherein the airfoil portion further includes a leading end, a trailing end, and a step-down region disposed between the leading end and the training end;

wherein the leading end of the airfoil portion is disposed at the lower edge of the face portion; and wherein the step-down region is configured to generate a vortex along the sole portion of the golf club head between the face portion and the rearward end portion.

14. The golf club head according to claim 9, wherein the downward facing surface curves more towards the rearward end portion than the upward facing surface.

15. The golf club head according to claim 9, wherein the airfoil portion further comprises:

a raised suction surface disposed adjacent the face portion;

a recessed suction surface disposed rearwardly of the raised suction surface; and an elliptic surface connecting the raised suction surface and the recessed suction surface.

16. The golf club head according to claim 9, wherein the golf club head includes a toe portion and a heel portion, and wherein the sole portion includes a toe side airfoil portion that extends rearwardly from the airfoil portion along the toe portion.

17. The golf club according to claim 16, wherein the toe side airfoil portion controls airflow around the toe portion of the golf club head.

18. The golf club head according to claim 9, wherein the golf club head includes a toe portion and a heel portion, and wherein the sole portion includes a heel side airfoil portion that extends rearwardly from the airfoil portion along the heel portion.

19. The golf club according to claim 18, wherein the heel side airfoil portion controls airflow around the heel portion of the golf club head.

20. The golf club head according to claim 9, wherein the downward facing surface curves more towards the rearward end portion than the upward facing surface.

* * * * *